United States Patent [19]

Grushkin et al.

[11] 4,407,922

[45] Oct. 4, 1983

[54] PRESSURE SENSITIVE TONER COMPOSITIONS

[75] Inventors: Bernard Grushkin, Pittsford; Jacques C. Bertrand, Ontario, both of N.Y.

[73] Assignee: Xerox Corporation, Stamford, Conn.

[21] Appl. No.: 338,683

[22] Filed: Jan. 11, 1982

[51] Int. Cl.[3] ..... G03G 11/00

[52] U.S. Cl. ..... 430/98; 430/109; 430/110; 430/126

[58] Field of Search ..... 430/106.6, 109, 126, 430/98, 110

[56] References Cited

U.S. PATENT DOCUMENTS

| | | | |
|---|---|---|---|
| 3,391,082 | 7/1968 | Maclay | 252/62.1 |
| 3,502,582 | 3/1970 | Clemens et al. | 252/62.1 |
| 3,804,764 | 4/1974 | Strella et al. | 252/62.1 |
| 3,806,458 | 4/1974 | Tanck et al. | 252/62.1 |
| 3,900,414 | 8/1975 | Tanck et al. | 252/62.1 P |
| 3,928,656 | 12/1975 | Strella et al. | 427/22 |
| 3,959,404 | 5/1976 | Labana et al. | 260/830 TW |
| 3,965,021 | 6/1976 | Clemens et al. | 252/62.1 P |
| 4,246,332 | 1/1981 | Tanaka et al. | 430/109 |
| 4,340,660 | 7/1982 | Kiuchi et al. | 430/106.6 |

*Primary Examiner*—John E. Kittle
*Assistant Examiner*—John L. Goodrow
*Attorney, Agent, or Firm*—E. O. Palazzo

[57] ABSTRACT

This invention is directed to an improved cold pressure flexible toner composition comprised of a blend of two immiscible polymers selected from the group consisting of (1) a polymer of polystyene-co-stearylmethacrylate as a hard component, and poly[octadecyl vinyl ether-co-maleic anhydride] as a soft component, and (2) polyisobutylmethacrylate composition as a hard component, and poly[octadecyl vinyl ether-co-maleic anhydride], as a soft component, the soft component being present in an amount of from about 35 percent by weight to about 75 percent by weight, and the hard component being present in an amount of from about 25 weight percent to about 65 weight percent; and the use of such compositions for developing images in electrostatographic imaging systems.

21 Claims, No Drawings

PRESSURE SENSITIVE TONER COMPOSITIONS

BACKGROUND OF THE INVENTION

This invention is generally directed to toner compositions that are pressure sensitive, and more specifically the present invention is directed to toner compositions containing blends of two or more immiscible polymers, which compositions are very useful in causing the development of images in electrostatographic imaging systems wherein pressure fixing, especially pressure fixing without the pressure of heat, is employed. In one embodiment the toner compositions of the present invention are comprised of a blend of two immiscible polymers, and a plasticizer.

The development of electrostatographic images, and in particular, electrostatic images utilizing developer compositions containing toner materials is well known. In these systems, an electrostatic latent image is formed on a photoconductive member, and the image is developed with a toner composition comprised of resin particles and carbon black. Subsequently the developed image is transferred to a suitable substrate, where fixing is accomplished by heat. Thus, final copies of the toner image are produced by heating the toner to a temperature at which the toner particles begin to flow in order to effect fusing of the particles to a support substrate, such as paper. Such a fixing process generally requires substantial amounts of energy, and prior to producing the first copy in a machine employing heat pressure fix systems, it is necessary to allow the machine to reach an appropriate temperature in order that the first copy can be fused properly. Other fixing systems are known including radiant fusing, vapor pressure fusing, pressure fusing, a combination of pressure heat fusing systems, and the like.

Cold pressure fusing has a number of advantages, primarily relating to the requirement for less energy, since the toner compositions involved can be fixed at room temperature. Nevertheless, many toner compositions used in prior art cold pressure fixing systems suffer from a number of deficiencies. For example, these toner compositions must usually be fused under high pressures, which pressures have a tendency to severely disrupt the toner fusing characteristics of the compositions employed. This results in images of low resolution, or no images whatsoever, and in some of these systems, substantial image smearing has been noticed because of the high pressures required. While attempts have been made to improve toner compositions for cold pressure fix systems, such compositions in many instances have a number of undesirable characteristics, including agglomeration of particles at room temperature, insufficient flowability under high pressures, lack of adhesion to the support substrate, such as paper, unsuitable blocking temperatures, and an insufficient brittleness to allow preparation of such materials by, for example, known commercial jetting methods, or known fluid energy milling processes.

Accordingly, there continues to be a need for improved toner compositions for use in imaging systems utilizing cold pressure fixing processes. More specifically, there is a need for cold pressure fix toner compositions which exhibit excellent flowability at high pressures, adhere to the substrate on which the image is to be permanently fixed, such as plain bond paper, have suitable blocking temperatures, and are of sufficient brittleness to allow comminution, utilizing known jetting processes, or fluid energy mills.

SUMMARY OF THE INVENTION

It is a feature of the present invention to provide toner compositions which overcome the above-noted disadvantages.

A further feature of the present invention is the provision of toner compositions comprised of immiscible blends of two or more polymers, and carbon black, which toner compositions are useful in cold pressure fixing systems.

In an additional feature of the present invention, there is provided toner compositions comprised of plasticizers, and immiscible blends of certain polymers, which compositions can be prepared by known jetting techniques.

In yet another feature of the present invention, there is provided cold pressure fixable toner compositions which exhibit sufficient flowability at high pressure rates, do not agglomerate or block at certain temperatures, and adhere to suitable substrates such as plain bond paper.

In a further feature of the present invention, there is provided developer compositions comprised of toner particles containing an immiscible bond of two or more polymers, and carbon black, which developer compositions are useful for developing images utilizing cold pressure fixing techniques.

These and other features of the present invention are accomplished by the provision of a pressure fixable toner composition comprised of a blend of two or more immiscible polymers selected from the group consisting of a blend of a polymer of polystyrene-co-stearylmethacrylate and poly[octadecylvinylether-co-maleic anhydride]; and polyisobutylmethacrylate polymers and poly[octadecylvinylether-co-maleic anhydride]. In one embodiment thus, the toner composition of the present invention is comprised of a hard component, such as a polyisobutylmethacrylate, or a polystyrene co-stearylmethacrylate composition, and as a soft component, poly[octadecylvinylether-co-maleic anhydride], in certain proportions, enabling the utilization of such toner compositions in cold pressure fix imaging systems. Additionally, the toner compositions of the present invention exhibit sufficient flowability to allow proper development to occur, do not agglomerate or block at temperatures of 120° F., and have sufficient adhesion properties to allow such compositions to be permanently bonded to suitable substrates, especially plain bond paper. There is also provided in accordance with the present invention toner compositions comprised of a blend of hard components and soft components, wherein the soft component contains a plasticizer.

While it is not desired to be limited to theory, it is believed that the hard component, such as the polystyrene-co-stearylmethacrylate or polyisobutylmethacrylate, functions as a reinforcing component primarily for the purpose of imparting brittleness and improving blocking characteristics of the resulting toner composition within which the hard component is present, while the soft component functions as a plastically deformable material possessing adhesive properties. The soft component thus, increases the compressibility of the resulting toner composition.

The polystyrene-co-stearyl-methacrylate hard component polymer of the present invention can be prepared by suspension polymerization employing for example, the respective copolymers in a weight ratio of about 80 percent polystyrene and 20 percent stearyl methacrylate. More specifically, this particular hard component polymer, which has a number average molecular weight of from about 8,000 to about 20,000, and preferably from about 10,000 to about 15,000, can be prepared by reacting together from about 70 percent to about 90 percent by weight of styrene, and preferably about 85 percent by weight of styrene, and from about 10 percent to about 30 percent by weight of stearyl methacrylate, and preferably 15 percent by weight of stearyl methacrylate, in the presence of a polymerization initiator such as benzoyl peroxide, such reaction being accomplished at a temperature of from about 80 degrees Centigrade to about 100 degrees Centigrade. Polymerization is completed by maintaining the temperature of the reaction mixture for a period of about 10 hours. Subsequently the reaction mixture is allowed to cool, and there is isolated a polystyrene-co-stearylmethacrylate composition possessing a glass transition temperature of from about 55 degrees Centigrade to about 57 degrees Centigrade. Other polystyrene-co-stearylmethacrylate compositions can be employed as the hard component for the toner compositions of the present invention, providing such compositions have a number average molecular weight of from about 8,000 to about 20,000, and preferably from about 10,000 to about 15,000, and have a glass transition temperature within the range of from about 50 degrees Centigrade to about 65 degrees Centigrade.

The polyisobutylmethacrylate hard component polymer composition of the present invention, which has a number average molecular weight of from about 100,000 to about 200,000 and a glass transition temperature of from about 50 degrees Centigrade to about 60 degrees Centigrade, can be prepared by known suspension polymerization techniques.

In a preferred important embodiment of the present invention, there is incorporated in the soft component, various plasticizers such as poly[12-hydroxystearic acid], (PHSA), a monomeric plasticizer commercially available from Emergy Industries as Plastolein 9058, polymeric plasticizers commercially available from Emergy Industries such as Plastolein 9780, and the like. The plasticizer is selected so as to be totally miscible with the soft component, that is, the plasticizer is completely dissolved in the soft component. Generally, the plasticizer is dissolved in the soft component in an amount of from about 5 weight percent to about 20 weight percent, and preferably in an amount of from about 13 weight percent to about 15 weight percent. The plasticizer can be incorporated into the soft component by a number of known techniques including for example melt blending, or by addition to a solution of the soft component, subsequent to which the solvent can be evaporated by spray drying techniques.

The polymeric blend in the toner composition of the present invention is comprised of from about 35 percent by weight to about 75 percent by weight of the soft component, and from about 25 percent by weight to about 65 percent by weight of the hard component. In a preferred embodiment the polymeric composition of the present invention is comprised of about 65 percent by weight of the soft component, and about 35 percent by weight of the hard component. As indicated hereinbefore, a plasticizer can be incorporated into the soft component in an amount of from about 5 weight percent to about 20 weight percent, and preferably in an amount of from about 13 weight percent to about 15 weight percent based on the weight of the soft component. It is important that the plasticizer be incorporated into the soft component and not the hard component, and further, that the plasticizer be totally miscible or dissolvable in the soft component.

Mechanical properties of the toner compositions of the present invention that are altered with the presence of the soft component, as indicated herein generally include an increase in compressibility and reduced maximum yield strength, of the resulting toner composition. The compressibility is further reduced by inclusion of plasticizers.

The toner compositions of the present invention can be prepared by a number of known techniques, thus in one embodiment, the toner composition of the present invention was prepared by mixing together about 32 percent by weight of the hard component polystyrene-co-stearylmethacrylate, and about 60 percent by weight of the soft component poly[octadecyl vinyl ether-co-maleic anhydride], which soft component has a number average molecular weight of from about 5,000 to about 20,000, and about 8 percent by weight of carbon black, such as Regal 330 by melt blending and jetting the resulting mixture so as to result in toner particles having a size of from about 10 microns to about 20 microns. The jetting process involved reducing the size of the blended materials to about 100–200 microns using a Fitz mill subsequent to which the materials were passed through a fluid energy mill. The resulting powder was then classified to provide toner particles with a volume average particle size of about 15 microns. The plasticizer, when incorporated into the toner compositions of the present invention can be added as indicated hereinbefore.

In a further embodiment of the present invention there is provided a method for developing electrostatographic images, which comprises causing the formation of an electrostatic latent image on an imaging surface, such as known photoconductive members including selenium, selenium arsenic alloys, and the like, contacting the latent image with developer particles containing toner particles comprised of a blend of two or more immiscible polymers, fully described herein, and as an optional ingredient a plasticizer, followed by transferring the developed image to a suitable substrate such as plain bond paper, and permanently affixing the image thereto. In one embodiment, fixing is accomplished by cold pressure fusing rollers, employing pressures of from about 460 pounds per linear inch to about 900 pounds per linear inch.

The toner particles can contain numerous known suitable colorants or dyes in addition to carbon black, including for example, nigrosine dye, Amoplast black dye, commercially available from National Aniline Products, Inc., various magnetic materials such as magnetites like Mapico Black, commercially available from Northern Pigments, Inc., and the like. Generally colorants such as carbon black are preent in an amount of from about 3 percent to about 20 percent by weight, based on the total weight of toner, although percentages outside these ranges may be useful, while the magnetic materials can be present in an amount of from about 20 percent to about 70 percent by weight.

The invention will now be described in detail with respect to specific preferred embodiments, it being noted that such embodiments are intended to be illustrative only, and the invention is not intended to be necessarily limited to the conditions specified in the Examples. All parts and percentages are by weight unless otherwise indicated.

EXAMPLE I

There was prepared by melt blending following by mechanical attrition a toner composition comprised of 27.6 weight percent of polystyrene-co-stearylmethacrylate, number average molecular weight of 12,000, 56 percent by weight of poly[octadecyl vinyl ether-co-maleic anhydride], commercially available as GANTREZ-AN8194 from GAF Corporation, 8 weight percent of Regal 330 carbon black, and 8.4 weight percent of the plasticizer poly(12-hydroxystearic acid).

The above toner composition which did not agglomerate, at a temperature of 120° F. was utilized to develop electrostatic latent images formed on a selenium photoreceptor, which images after transfer were subsequently fused to plain bond paper with cold pressure rollers under a pressure of 460 pounds per linear inch. Excellent final copies of high resolution resulted, and no smearing of the resulting images were noted from a visual observation of such images.

EXAMPLE II

A toner composition was prepared in accordance with Example I with the exception that there was utilized in place of the polystyrene-co-stearylmethacrylate, a polyisobutylmethacrylate having a number average molecular weight of 150,000, and a glass transition temperature of 52 degrees Centigrade.

Substantially, similar results were obtained when the toner composition of this Example was used to develop images in accordance with Example I, with fixing being accomplished by cold pressure rollers under a pressure of 600 pounds per linear inch.

EXAMPLE III

The following toner compositions which are comprised of 46 percent of the hard component specified, 46 weight percent of the soft component indicated, and 8 percent by weight of Regal 330 carbon black, and the percentage of plasticizer recited, which compositions (1) to (9) together with compositions (10) and (11) were tested for fixing level and smear characteristics, with the following results:

| | Hard Component | Soft Component | Fixing Level | Smear Level |
|---|---|---|---|---|
| (1) | Polystyrene-co-stearylmethacrylate | Poly[octadecylvinylether-co-maleic anhydride] No plasticizer | .41 | .15 |
| (2) | Polystyrene-co-stearylmethacrylate | Poly[octadecylvinylether-co-maleic anhydride], +13% poly[12-hydroxy stearic acid] Plasticizer (PHSA) | .52 | .12 |
| (3) | Polystyrene-co-stearylmethacrylate | Poly[octadecylvinylether-co-maleic anhydride], + 5% Plasticizer, Plastolein 9058 | .32 | .15 |
| (4) | Polystyrene-co-stearylmethacrylate | Poly[octadecylvinylether-co-maleic anhydride], + 10% Plasticizer, Plastolein 9058 | .36 | .12 |
| (5) | Polystyrene-co-stearylmethacrylate | Poly[octadecylvinylether-co-maleic anhydride], + 20% Plasticizer, Plastolein 9058 | .53 | .10 |
| (6) | Polystyrene-co-stearylmethacrylate | Poly[octadecylvinylether-co-maleic anhydride], + 5% Plasticizer, Plastolein 9780 | .35 | .11 |
| (7) | Polystryrene-co-stearylmethacrylate | Poly[octadecylvinylether-co-maleic anhydride], + 10% Plasticizer, Plastolein 9780 | .40 | .12 |
| (8) | Polystyrene-co-stearylmethacrylate | Poly[octadecylvinylether-co-maleic anhydride], + 20% Plasticizer, Plastolein 9780 | .45 | .09 |
| (9) | Polyisobutyl-methacrylate | Poly[octadecylvinyl-ether-co-maleic anhydride], +20% Plasitcizer (PHSA) | .41 | .09 |
| (10) | A toner comprised of a rosin ester and a polyamide | | .31 ± .1 | .06 ± .02 |
| (11) | A polyethylene/polyvinyl acetate copolymer toner resin modified with dimethyl siloxane, iron oxide, and carbon black | | .45 | .19 |

The fixing level of the above-identified materials were determined by employing a known Tabor abrasion test utilizing a 1,000 gram load, CS-10 Abrasion wheel for 10 cycles, and by measuring the initial optical density, $d_o$, the optical density of the abraded area subsequent to abrasion, (d) and the optical density of the non-abraded area subsequent to abrading $d_s$. The fixing level is thus obtained by subtracting $d_s$ from (d) and dividing the resulting sum by $d_o$. The smearing measurements were arrived at in a similar manner with the exception that the optical density of the non-abraded area subsequent to abrasion, namely $d_s$ is divided by the initial optical density before abrasion, namely $d_o$.

The higher the fixing level number, the better the fix while superior smear resistance is obtained with those materials which have a lower smear number. Thus the composition identified as (2) has a fixing level of 0.52, and a smear level of 0.12, as compared with for example toner (10) which has a fixing level significantly lower, 0.31±1, but a slightly better smear level namely 0.06±0.02.

EXAMPLE IV

There was prepared by melt blending a toner composition comprised of 46 percent by weight of the polystyrene-co-stearylmethacrylate of Example I, 46 percent by weight of the poly[octadecyl vinyl ether-co-maleic anhydride] of Example I, and 8 percent by weight of Regal 330 carbon black. The resulting composition was attritted to particles having a 13 micron volume average particle size.

The above toner composition is utilized to develop electrostatic latent images formed on a selenium photoreceptor, which images after transfer were fused to plain bond paper with cold pressure rollers, under a pressure of 500 pounds per linear inch. Good first copies of acceptable resolution resulted, and substantially no smearing of the resulting images were noted from a visual observation thereof.

Other modifications of the present invention may occur to those skilled in the art, and these are intended to be included within the scope of the present invention.

We claim:

1. An improved cold pressure fixable toner composition comprised of a blend of two immiscible polymers selected from the group consisting of (1) a polymer of polystyrene-co-stearylmethacrylate as a hard component, having a number average molecular weight of from about 8,000 to about 20,000, and a glass transition temperature within the range of from about 50 degrees Centigrade to about 65 degrees Centigrade, and poly[octadecyl vinyl ether-co-maleic anhydride], having a number average molecular weight of from about 5,000 to about 20,000, as a soft component, and (2) polyisobutylmethacrylate compositions as a hard component, having a number average molecular weight of from about 100,000 to about 200,000, and a glass transition temperature of from about 50 degrees Centigrade to about 60 degrees Centigrade, and poly[octadecyl vinyl ether-co-maleic anhydride] as a soft component, the soft component being present in an amount of from about 35 percent by weight to about 75 percent by weight, and the hard component being present in an amount of from about 25 weight percent to about 65 weight percent.

2. A toner composition in accordance with claim 1 wherein the blend of immiscible polymers is comprised of polystyrene-co-stearylmethacrylate, and poly[octadecyl vinyl ether-co-maleic anhydride].

3. A toner composition in accordance with claim 1 wherein the blend of immiscible polymers is selected from polyisobutylmethacrylate compositions, and poly[octadecyl vinyl ether-co-maleic anhydride].

4. A toner composition in accordance with claim 1 wherein the soft component is present in an amount of 65 percent by weight, and the hard component is present in an amount of 35 weight percent.

5. An improved toner composition useful in cold pressure fixable imaging systems comprised of a blend of two immiscible polymers selected from the group consisting of (1) a polymer of polystyrene-co-stearylmethacrylate as a hard component, having a number average molecular weight of from about 8,000 to about 20,000, and a glass transition temperature within the range of from about 50 degrees Centigrade to about 65 degrees Centigrade, and poly[octadecyl vinyl ether-co-maleic anhydride] having a molecular weight of from about 5,000 to about 20,000 as a soft component, and (2) polyisobutylmethacrylate compositions as a hard component, having a number average molecular weight of from about 100,000 to about 200,000, and a glass transition temperature of from about 50 degrees Centigrade to about 60 degrees Centigrade, and poly[octadecyl vinyl ether-co-maleic anhydride] as a soft component, and further including in the soft component a plasticizer, the soft component being present in an amount of from about 35 percent by weight to about 75 percent by weight, the hard component being present in an amount of from about 25 percent by weight to about 65 percent by weight, and the plasticizer being present in the soft component in an amount of from about 5 percent by weight to about 20 percent by weight based on the weight of the soft components.

6. A toner composition in accordance with claim 5 wherein the blend of immiscible polymers is comprised of polystyrene-co-stearylmethacrylate, and poly[octadecyl vinyl ether-co-maleic anhydride], and the plasticizer is a poly[12-hydroxy stearic acid].

7. A toner composition in accordance with claim 5 wherein the immiscible polymers are comprised of polyisobutylmethacrylate compositions, and poly[octadecyl vinyl ether-co-maleic anhydride], and the plasticizer is a poly[12-hydroxy stearic acid].

8. A toner composition in accordance with claim 5 wherein the plasticizer is present in an amount of from about 13 weight percent to about 15 weight percent, based on the weight of the soft component.

9. A toner composition in accordance with claim 1 further including a colorant.

10. A toner composition in accordance with claim 5 further including a colorant.

11. A toner composition in accordance with claims 9 or 10, wherein the colorant is carbon black.

12. A method of developing images in an electrostatographic imaging system which comprises, causing the formation of an electrostatic latent image on an imaging surface, developing the image with a toner composition comprised of a blend of immiscible polymers selected from the group consisting of (1) polystyrene-co-stearylmethacrylate as a hard component having a number average molecular weight of from about 8,000 to about 20,000, and a glass transition temperature within the range of from about 50 degrees Centigrade to about 65 degrees Centigrade, and poly[octadecyl vinyl ether-co-maleic anhydride] having a molecular weight of from about 5,000 to about 20,000 as a soft component, and (2) polyisobutylmethacrylate compositions as a hard component having a number average molecular weight of from about 100,000 to about 200,000, and a glass transition temperature of from about 50 degrees Centigrade to about 60 degrees Centigrade, and poly[octadecyl vinyl ether-co-maleic anhydride] as a soft component, the soft component being present in an amount of about 35 weight percent to about 75 weight percent, and the hard component being present in an amount of from about 25 weight percent to about 65 weight percent, followed by transferring the image to a permanent substrate, and permanently fixing the image thereon.

13. A method of imaging in accordance with claim 12 wherein fixing is accomplished by pressure rollers at a pressure of from about 460 pounds per linear inch to about 900 pounds per linear inch.

14. A method of imaging in accordance with claim 9 wherein the immiscible polymer blend is comprised of a polystyrene-co-stearylmethacrylate hard component, and a poly[octadecyl vinyl ether-co-maleic anhydride] soft component.

15. A method of imaging in accordance with claim 12 wherein the immiscible polymer blend is a polyisobutylmethacrylate polymer hard component and a poly[octadecyl vinyl ether-co-maleic anhydride] soft component.

16. A method of imaging in accordance with claim 12 wherein the toner compositions employed further includes a plasticizer in the soft component, said plasticizer being present in an amount of from about 5 weight percent to about 20 weight percent.

17. A method of imaging in accordance with claim 16 wherein the plasticizer is present in an amount of from about 13 weight percent to about 15 weight percent.

18. A method of imaging in accordance with claim 16 wherein the plasticizer is a poly[12-hydroxystearic acid].

19. A method of imaging in accordance with claim 12 wherein the toner composition further includes a colorant.

20. A method of imaging in accordance with claim 16 wherein the toner composition further includes a colorant.

21. A method of imaging in accordance with claims 19 or 20 wherein the colorant is carbon black.

* * * * *